US012624524B2

(12) United States Patent
Deng et al.

(10) Patent No.: US 12,624,524 B2
(45) Date of Patent: May 12, 2026

(54) BENDING BOOM, BOOM DEVICE, AND WORK MACHINE

(71) Applicant: SANY AUTOMOBILE MANUFACTURING CO., LTD., Changsha (CN)

(72) Inventors: Biao Deng, Changsha (CN); Jiangbo Li, Changsha (CN)

(73) Assignee: SANY AUTOMOBILE MANUFACTURING CO., LTD., Changsha (CN)

( * ) Notice: Subject to any disclaimer, the term of this patent is extended or adjusted under 35 U.S.C. 154(b) by 307 days.

(21) Appl. No.: 18/472,558

(22) Filed: Sep. 22, 2023

(65) Prior Publication Data

US 2024/0011242 A1 Jan. 11, 2024

Related U.S. Application Data

(63) Continuation of application No. PCT/CN2021/103254, filed on Jun. 29, 2021.

(30) Foreign Application Priority Data

Apr. 28, 2021 (CN) ..... 202120904704.7

(51) Int. Cl.
*E02F 9/14* (2006.01)
*E02F 3/38* (2006.01)

(52) U.S. Cl.
CPC . *E02F 9/14* (2013.01); *E02F 3/38* (2013.01)

(58) Field of Classification Search
USPC ..... 414/722, 727
See application file for complete search history.

(56) References Cited

U.S. PATENT DOCUMENTS 8,251,095 B2 * 8/2012 Trumper ..... E04G 21/0436 239/165
8,297,906 B2 * 10/2012 Nabata ..... E02F 3/38 414/722

(Continued)

FOREIGN PATENT DOCUMENTS

CN 102561703 A 7/2012
CN 102587670 A 7/2012

(Continued)

OTHER PUBLICATIONS

International Search Report and Written Opinion issued in corresponding PCT Application No. PCT/CN2021/103254, dated Jan. 27, 2022.

(Continued)

*Primary Examiner* — Michael S Lowe
(74) *Attorney, Agent, or Firm* — Westbridge IP LLC

(57) ABSTRACT

Disclosed are a bending boom, a boom device and a work machine. The bending boom includes a middle portion and two extending portions. The middle portion is configured to connect external components. The extending portion has a first side wall and a second side wall opposite to the first side wall. The first side wall is flush with middle portion, and the second side wall is bent from middle portion towards a direction near first side wall. The two extending portions are connected to two opposite ends of middle portion. By providing the matching middle portion and extending portions, a situation in which stress concentration occurs at the middle portion can be prevented, which improves stress condition of the bending boom, and improves durability of the bending boom, the boom device and the work machine.

6 Claims, 5 Drawing Sheets

(56) References Cited

U.S. PATENT DOCUMENTS

| | | | | |
|---|---|---|---|---|
| 9,822,535 | B2 | 11/2017 | Maini et al. | |
| 9,828,780 | B2 | 11/2017 | Rau et al. | |
| 11,149,403 | B2 * | 10/2021 | Wada | E02F 3/369 |
| 11,952,788 | B2 * | 4/2024 | Häfner | E04G 21/0445 |

FOREIGN PATENT DOCUMENTS

| | | | |
|---|---|---|---|
| CN | 203022353 | U | 6/2013 |
| CN | 108884654 | A | 11/2018 |
| CN | 109931079 | A | 6/2019 |
| EP | 0838563 | A1 | 4/1998 |
| WO | 2019105983 | A1 | 6/2019 |

OTHER PUBLICATIONS

Extended European Search Report issued in counterpart European Patent Application No. 21938731.3, dated Jan. 20, 2025.

* cited by examiner

BENDING BOOM, BOOM DEVICE, AND WORK MACHINE

CROSS-REFERENCE TO RELATED APPLICATIONS

This application is a continuation application of International Application No. PCT/CN2021/103254, filed on Jun. 29, 2021, which claims priority to Chinese Patent Application No. 202120904704.7, filed on Apr. 28, 2021. The above-mentioned applications are incorporated herein by reference in their entireties.

TECHNICAL FIELD

The present application relates to the technical field of technical equipment for work machine, in particular to a bending boom, a boom device, and a work machine.

BACKGROUND

A boom is a commonly used device in a work machine that transports materials to a certain location. A boom assembly is typically of a multi-section structure and has a folding function, which facilitates transporting and working.

A bending portion of a conventional boom is generally located in front of an oil cylinder base. As shown in FIG. 1, the boom 10' has a connecting portion 101 and a bending portion 102 which are connected, and the connecting portion 101 is connected to the oil cylinder base. Since a distance between two ends of the boom 10' is small, stress concentration is prone to occur at the bending portion 102 of the boom 10', which brings a poor stress condition and affects the durability of the boom 10'.

Therefore, there is a need to improve the above technical solution to change the current situation.

SUMMARY

The present application aims to solve at least one of the problems existing in the existing art or the related art.

For this, the purpose of the present application is to provide a bending boom, a boom device and a work machine to solve the problem that stress concentration is prone to occur at a bending portion of a boom in a conventional work machine, and thereby affecting the durability.

To achieve the above purpose, the technical solution according to a first aspect of the present application provides a bending boom, which includes a middle portion and two extending portions: the middle portion is configured to connect an external component: each extending portion has a first side wall and a second side wall opposite to the first side wall: the first side wall is flush with the middle portion, and the second side wall is at least partially bent from the middle portion towards a direction near the first side wall: the two extending portions are connected to two opposite ends of the middle portion, the first side walls of the two extending portions are connected to two different side walls of the middle portion, and the second side walls of the two extending portions are connected to two different side walls of the middle portion.

According to a bending boom provided by the present application, the first side wall and the second side wall of the same extending portion have separated projections on a horizontal plane.

According to a bending boom provided by the present application, a longitudinal section area of the extending portion gradually decreases from the middle portion towards a direction away from the middle portion.

According to a bending boom provided by the present application, the second side wall includes a bending section, one end of the bending section is connected to the middle portion, and the bending section is bent from the middle portion towards a direction near the first side wall.

According to a bending boom provided by the present application, the bending section is arc-shaped, and a curvature in a middle of the bending section is greater than the curvature on two sides.

According to a bending boom provided by the present application, the second side wall further includes a connecting section, the connecting section is connected to one end of the bending section away from the middle portion, and the connecting section is parallel to the first side wall.

According to a bending boom provided by the present application, the bending boom further includes an oil cylinder base, the oil cylinder base is connected to the middle portion and configured to connect an external oil cylinder.

The technical solution according to a second aspect of the present application provides a boom device, which includes a front boom, a rear boom, and any one of the bending booms described above: the front boom and the rear boom are articulated to two ends of the bending boom.

According to a boom device provided by the present application, the boom device further includes a first sectional boom: one end of the first sectional boom is configured to be articulated to a rotating platform of a vehicle body, and the other end of the first sectional boom is articulated to the front boom; the front boom is a second sectional boom, the bending boom is a third sectional boom, and the rear boom is a fourth sectional boom: the first sectional boom, the second sectional boom and a head section of the third sectional boom occupy one column of space; and the fourth sectional boom and an end section of the third sectional boom occupy another column of space.

The technical solution according to a third aspect of the present application provides a work machine, which includes the bending boom described in the first aspect or the boom device described in the second aspect.

In the bending boom of the embodiment, the bending transition of the extending portion in the bending boom is not too sharp, and the extending portions on the two sides are bent into place without bending one side into place, which brings a good stress condition and a low stress level to the extending portion. In addition, the middle portion can be made as wide as possible to provide a good structural stress and make the force transmission smooth. Besides, the bending boom in the embodiment has a larger width at the middle portion compared with a conventional boom, thereby improving the durability and strength of the bending boom.

In the bending boom of the embodiment, by providing the matching middle portion and extending portions, the bending structures in the bending boom can be staggered, and a situation in which stress concentration occurs at the middle portion can be prevented, which improves the stress condition and the durability of the bending boom.

In the boom device of the embodiment, by providing the bending boom with improved durability, the durability of the boom device is also improved and the use effect is good.

By installing the above boom device, the overall durability of the work machine in the embodiment is also improved, and the maintenance cost of the work machine is also reduced.

The additional aspects and advantages of the present application will become apparent through the following description, or become known through the practice of the present application.

BRIEF DESCRIPTION OF THE DRAWINGS

The above and/or the additional aspects and advantages of the present application will become apparent and easy to understand from the descriptions of the embodiments in conjunction with the following drawings.

DETAILED DESCRIPTION OF THE EMBODIMENTS

In order to make the purposes, technical solutions and advantages of the present application clearer, the technical solutions of the present application will be described clearly and completely below in combination with the accompanying drawings. Obviously, the embodiments to be described are only some rather than all the embodiments of the present application. All other embodiments obtained by those skilled in the art based on the embodiments of the present application without creative efforts shall fall within the scope of the present application.

Figure 1:
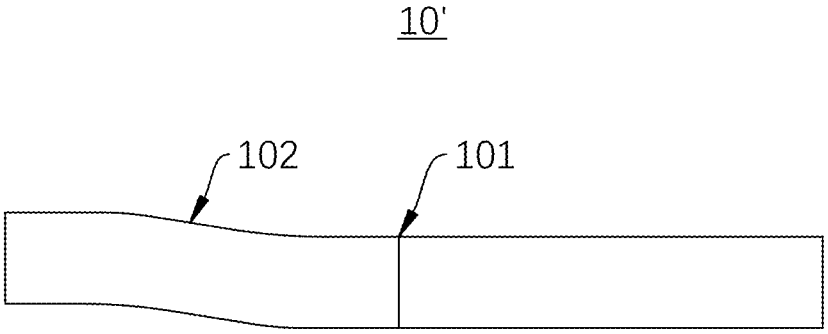
FIG. 1 (Prior Art)
FIG. 1 is a schematic view of a boom in the related art.
Figure 2:
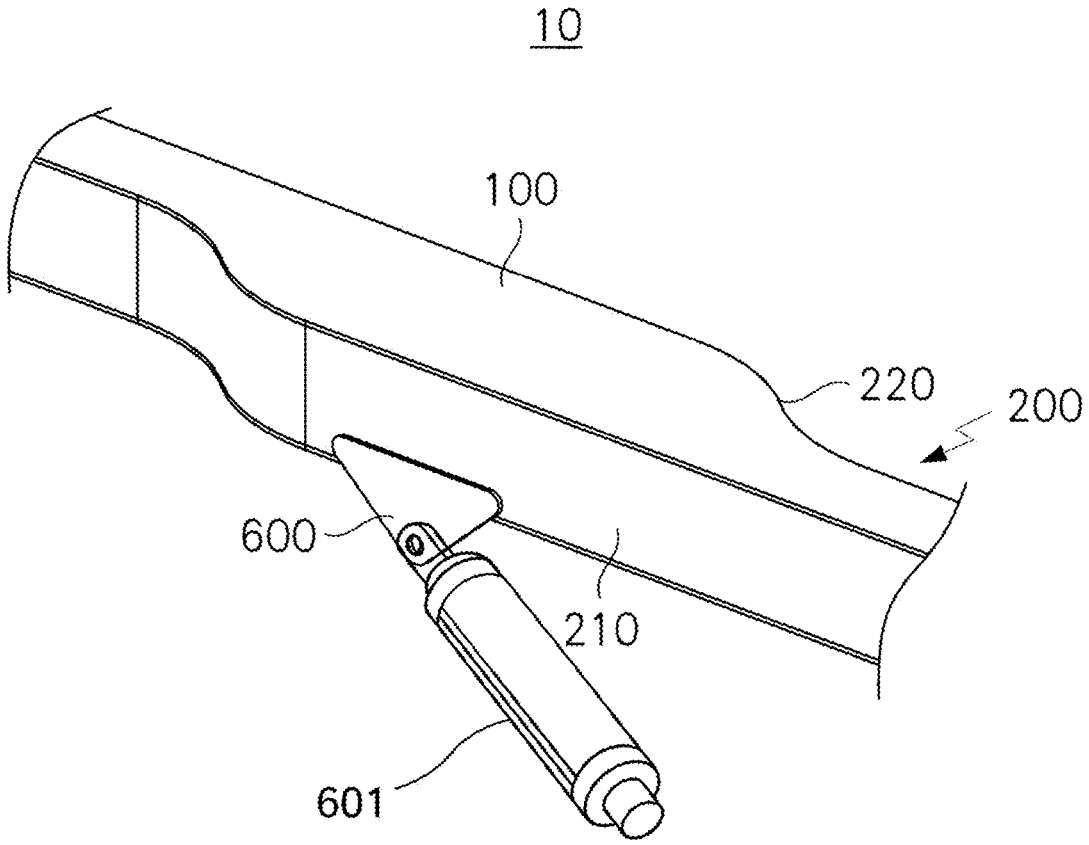
FIG. 2 is a partial axis side view of a bending boom according to an embodiment of the present application.

As shown in FIG. 2, an embodiment of the present application provides a bending boom 10 including a middle portion 100 and an extending portion 200. The middle portion 100 is used as a mounting carrier for installing external components. For example, when the bending boom 10) is used for a concrete pump truck, the external components can include a hydraulic cylinder, and there is no specific limit here.

Figure 3:
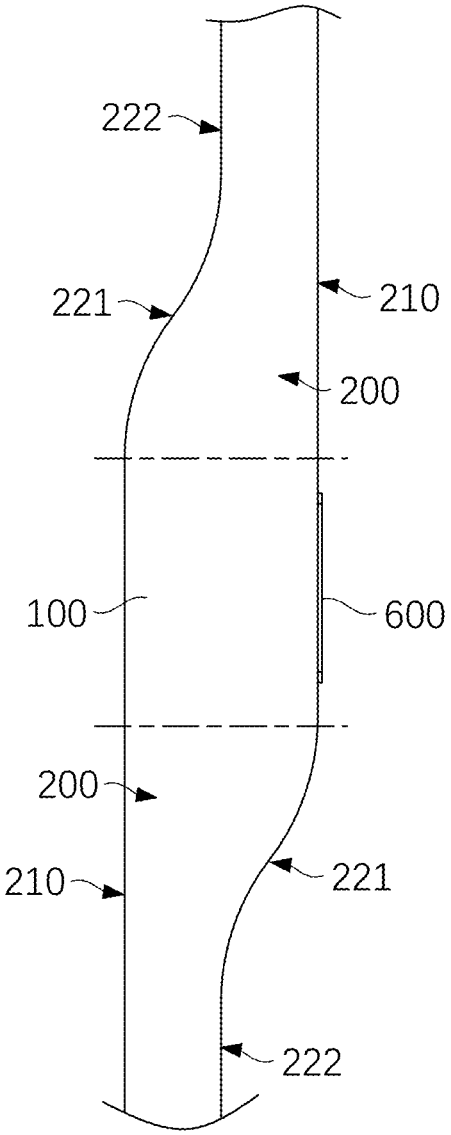
FIG. 3 is a top view of a bending boom according to an embodiment of the present application.

Specifically, referring to FIG. 3 together, the extending portion 200 has a first side wall 210) and a second side wall 220 opposite to the first side wall 210. The first side wall 210 is flush with the middle portion 100, and the second side wall 220 is at least partially bent from the middle portion 100 towards a direction near the first side wall 210. The number of the extending portion 200 is two, and the two extending portions 200 are connected to two opposite ends of the middle portion 100. The first side walls 210 of the two extending portions 200 are connected to two different side walls of the middle portion 100, respectively, and the second side walls 220 of the two extending portions 200 are connected to two different side walls of the middle portion 100, respectively. In some embodiments, the two extending portions 200 can be centrally symmetrical about the middle portion 100. The middle portion 100 can be of a linear type, that is, the middle portion 100 at least partially extends along a straight direction.

In the bending boom 10 of the above embodiment, the middle portion 100 is used for connecting external components such as an oil cylinder base 600. By arranging the two extending portions 200 at two opposite ends of the middle portion 100 symmetrically, a situation in which stress concentration occurs in the part of the bending boom 10 with which external components are connected can be prevented. Meanwhile, by providing the extending portion 200 with one of the side walls being flush with the middle portion 100, the bending boom 10 in this embodiment has a larger width at the middle portion 100 compared with a conventional boom, thereby improving the durability of the bending boom 10.

In the bending boom 10 of the above embodiment, by providing the matching middle portion 100 and extending portions 200, the bending structures in the bending boom 10 can be staggered, and a situation in which stress concentration occurs at the middle portion 100 can be prevented, which improves the stress condition and the durability of the bending boom 10.

As shown in FIG. 2, in an embodiment, projections of the first side wall 210 and the second side wall 220 of the same extending portion 200 on a horizontal plane are arranged separately.

By this arrangement, the first side wall 210 and the second side wall 220 can be arranged at two opposite sides of the bending boom 10 in a horizontal direction, which enables the bending boom 10 to fully utilize the surrounding space while connecting to other sectional booms and provides a compact structure. In other embodiments, the first side wall 210 and the second side wall 220 can also be arranged in a vertical direction, and by doing so, the whole structure can be arranged in the horizontal direction when the bending boom 10 is connected to other sectional booms.

Further, as shown in FIGS. 2 and 3, a longitudinal section area of the extending portion 200 gradually decreases from the middle portion 100 towards a direction away from the middle portion 100. Specifically, in an embodiment, as shown in FIG. 3, the width of the extending portion 200 in a left and right direction gradually decreases from the middle portion 100 towards the direction away from the middle portion 100. The decrease can be intermittent, or can be continuous as shown in FIG. 3. Referring to FIG. 2, the height of every part of the extending portion 200 is equal in an up and down direction.

In an embodiment, a small end of the extending portion 200 can be used to connect other sectional booms, and the middle portion 100 can be used to connect external components such as an oil cylinder. By doing so, the bending boom 10 can have a larger section size at the middle portion 100 to increase the overall strength of the bending boom 10. The bending of the extending portion 200 cannot cause a problem that stress concentration occurs to the bending boom 10, which brings a good use effect.

Figure 4:
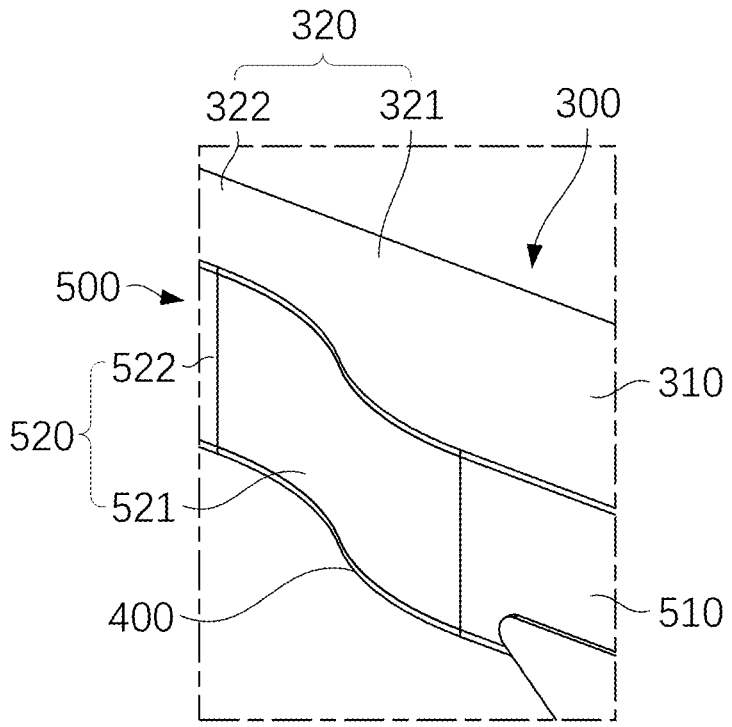
FIG. 4 is an enlarged view of a partial structure of the bending boom according to an embodiment of the present application.

As shown in FIGS. 3 and 4, in an embodiment, the second side wall 220 includes a bending section 221, one end of the bending section 221 is connected to the middle portion 100, and the bending section 221 is bent from the middle portion 100 towards a direction near the first side wall 210.

In an embodiment, the second side wall 220 can only be provided with the bending section 221, and one end of the bending section 221 away from the middle portion 100 can be used to connect other external components.

Specifically, the bending section 221 is arc-shaped, and a curvature in a middle of the bending section 221 is greater than the curvature on both sides.

As shown in FIGS. 2 to 4, in an embodiment, by providing the arc-shaped bending section 221, the side wall of the middle portion 100 and one end of the bending section 221 away from the middle portion 100 can be staggered, so that the bending boom 10 and a number of external sectional booms can be staggered when they are connected, therefore, the effects of compacting the structure and saving space can be achieved. In other embodiments, the sectional profile of the bending section 221 can also be a straight line, and there is no need to describe them in detail here.

Further, the second side wall 220 further includes a connecting section 222, the connecting section 222 is connected to one end of the bending section 221 away from the middle portion 100, and the connecting section 222 is parallel to the first side wall 210.

As shown in FIG. 3, in an embodiment, the bending sections 221 in the two sets of extending portions 200 are located at two opposite ends of the middle portion 100, respectively. Compared with the conventional boom 10', in an embodiment, the bending transition of the extending portion 200 in the bending boom 10 is not too sharp, and the extending portions 200 on the two sides are bent into place without bending one side into place, which brings a good stress condition and a low stress level to the extending portion 200. In addition, as shown in FIG. 2, the middle portion 100 can be made as wide as possible to provide a good structural stress and make the force transmission smooth when connected to an oil cylinder 601 through the oil cylinder base 600. Referring to the placement shown in FIG. 3, the middle portion 100 can be set a corresponding width according to practical design requirements, and the width size of the middle portion 100 cannot be affected by the bending structure, it is possible to ensure the strength of the middle portion 100 itself, and further the strength of the bending boom 10. The structure is simple and the use effect is good. In another embodiment, an angle can be formed between an extension direction of the connecting section 222 and the extension direction of the first side wall 210, and there is no limit here.

As shown in FIG. 4, in an embodiment, the bending boom 10 includes a top plate 300, a bottom plate 400, and a side plate 500. The top plate 300 and the bottom plate 400 are provided parallel to each other and with intervals. The side plate 500 includes a side plate connecting portion 510 and a side plate bending portion 520 which are connected. The side plate connecting portion 510 is connected between the top plate 300 and the bottom plate 400 to form the middle portion 100. The side plate bending portion 520 is connected between the top plate 300 and the bottom plate 400 to form the extending portion 200.

In an embodiment, the bending boom 10 is mainly composed of the top plate 300, the bottom plate 400 and the side plate 500. The side plate bending portion 520 can be formed by bending the side plate 500, and the bending boom 10 can be formed when the side plate 500, the top plate 300 and the bottom plate 400 are connected. The extending portion 200 can form a support structure inside the bending boom 10 along the direction in which the extending portion 200 is bent to ensure the strength of the bending boom 10.

It should be noted that, the top plate 300 can have the same shape as the bottom plate 400, which saves the cost of molds in the machining process. In some embodiments, the top plate 300 and the bottom plate 400 can also be configured as corresponding shapes according to practical requirements, and there is no limit here.

Specifically, as shown in FIG. 4, the top plate 300 includes a top plate connecting portion 310 and a top plate bending portion 320 which are connected. The top plate bending portion 320 includes a top plate bending section 321 and a top plate connecting section 322 which are connected. The top plate bending section 321 is connected to the top plate connecting section 322 and the top plate connecting portion 310, respectively. The side plate bending portion 520 includes a side plate bending section 521 and a side plate connecting section 522 which are connected, and the side plate bending section 521 is connected to the side plate connecting section 522 and the side plate connecting portion 510, respectively.

In an embodiment, the side plate bending section 521 is connected to the top plate bending section 321 and the bottom plate 400 to form the bending section 221, respectively. The side plate connecting section 522 is connected to the top plate connecting section 322 and the bottom plate 400 to form the connecting section 222, respectively.

As shown in FIG. 3, in an embodiment, two second side walls 220 are centrally symmetrical about the middle portion 100, that is, when the second side wall 220 at least partially extends along a straight line, at least a part of the two second side walls 220 are parallel to each other. In other embodiments, the two second side walls 220 can also be arranged not centrally symmetrical, for example, as shown in FIG. 3, a certain angle can be formed between profile lines of the two second side walls 220, and an opening direction of the angle can face upwards or downwards in the vertical direction.

Specifically, in an embodiment, the side plate 500 is connected to the top plate 300 and the bottom plate 400 by welding, respectively.

In the machining process, the two opposite ends of the side plate 500 can be welded to the top plate 300 and the bottom plate 400 to form the bending boom 10, which ensures the strength of the bending boom 10. In other embodiments, the side plate 500, the top plate 300 and the bottom plate 400 can be connected by detachable connections, such as screw connection, snap-fit connection, plug-fit connection, rivet connection or other connections.

Specifically, in an embodiment, the number of the side plate 500 is two, and the two side plates 500 are both disposed between the top plate 300 and the bottom plate 400 and are centrally symmetrical about the middle portion 100.

In an embodiment, by connecting the top plate 300 and the bottom plate 400 with the two side plates 500, a hollow box structure can be enclosed and formed whose section is rectangular. Compared to a boom with a solid interior, the bending boom 10 in the embodiment can reduce the total weight of the bending boom 10 in the precondition of ensuring the strength of the bending boom 10, which facilitates the light weight, transportation, assembly and use.

As shown in FIG. 3, in an embodiment, edges of the top plate 300 and the bottom plate 400 are a combination of straight lines and arcs, and are matched with the profile of a side surface of the side plate 500. In the assembly process, the positioning can be realized by the edge of the top plate 300 and the surface of the side plate 500, and after the side plate 500 is connected to the top plate 300 and the bottom plate 400, neat joint seams exist between two neighboring parts, which brings the bending boom 10 a coherent appearance.

In some embodiments shown in FIGS. 2 and 3, the number of the extending portion 200 is two, and the two extending portions 200 are connected to two opposite ends of the middle portion 100, respectively. The connecting sections 222 of the two extending portions 200 have the same section area.

In an embodiment, the connecting sections 222 on the two opposite ends of the middle portion 100 have the same width size, and two sets of the connecting sections 222 have the same section area, which makes the force transmission smooth on the bending boom 10. In other embodiments, the two sets of the connecting sections 222 can have different section area, and there is no limit here.

Figure 5:
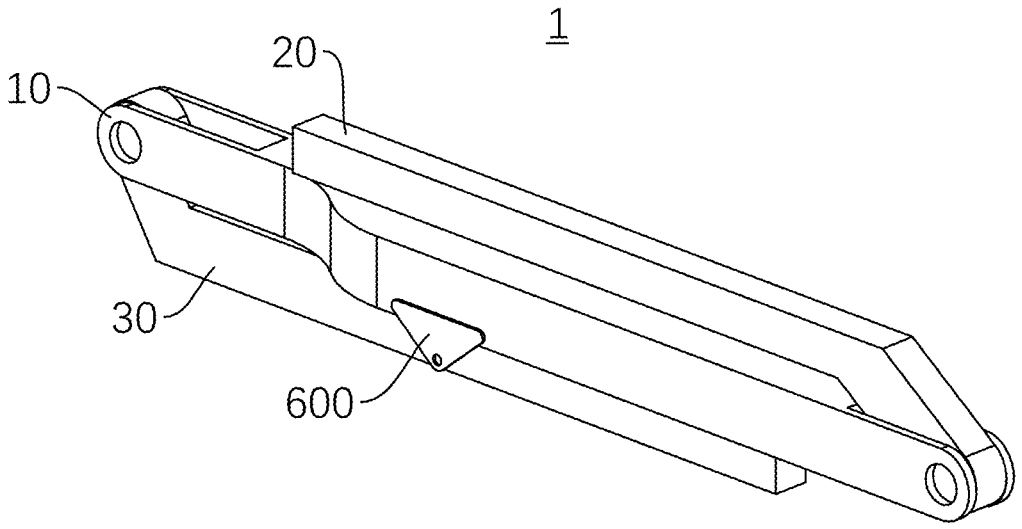
FIG. 5 is a schematic view of a partial structure of a boom device according to an embodiment of the present application.

As shown in FIG. 5, the present application further provides a boom device 1. The boom device 1 includes the bending boom 10 described in any one of the above embodiments.

It can be understood that, in the boom device 1 according to the present application, by providing the bending boom 10 with improved durability, the durability of the boom device 1 is also improved and the use effect is good.

Specifically, in an embodiment, the boom device 1 further includes a front boom 20 and a rear boom 30, the front boom 20 and the rear boom 30 are flexibly connected to two opposite ends of the bending boom 10, and the front boom 20 is parallel to the rear boom 30.

Figure 6:
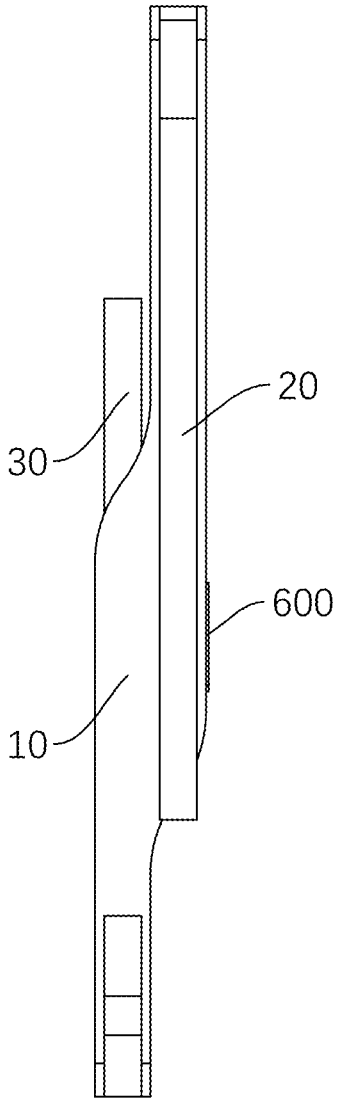
FIG. 6 is a top view of the boom device according to an embodiment of the present application.

In an embodiment, the front boom 20 and the rear boom 30 respectively connected to two opposite ends of the bending boom 10 are provided. Referring to the placement shown in FIG. 6, when the boom device 1 is in a folded state, the front boom 20 and the rear boom 30 can be staggered by the extending portions 200 provided by the bending boom 10, which facilitates the arrangement of two or more columns of the boom devices 1.

In some embodiments, the boom device 1 can further include a first sectional boom (not shown in the drawings), one end of the first sectional boom is used to articulate to a rotating platform of a vehicle body, and the other end of the first sectional boom is articulated to the front boom 20. The front boom 20 is a second sectional boom, the bending boom 10 is a third sectional boom, and the rear boom 30 is a fourth sectional boom. When folding the boom device 1, the first sectional boom, the front boom 20 and a head section of the bending boom 10 occupy the space located on one side of the bending boom 10 and are capable of moving in the space, while the rear boom 30 and an end section of the bending boom 10 occupy the space located on the other side of the bending boom 10 and are capable of moving in the space, which helps to reduce the overall height of the boom device 1. In other embodiments of the present application, the boom device 1 can further include a fifth sectional boom, a sixth sectional boom, and so on, and there is no limit to the number of booms.

In this way, by arranging the first, second, third, and fourth sectional booms, the boom device 1 can have a more compact structure in the precondition of meeting the requirement that the boom device 1 has a larger extension size, which reduces the space occupied by the boom device 1 and facilitates the arrangement and installation of the boom device 1 on vehicles. In other embodiments, the above bending boom 10 can also be the fourth sectional boom, and there is no limit here.

Further, the present application further provides a work machine, and the work machine includes the boom device 1 described in any one of the above embodiments. It can be understood that, by installing the above boom device 1, the overall durability of the work machine in the embodiment is also improved, and the maintenance cost of the work machine is also reduced. In an embodiment, the work machine can be, for example, a concrete pump truck or a fire fighting truck, or the like.

In an embodiment, the work machine further includes a hydraulic oil pipe (not shown in the drawings), and the hydraulic oil pipe is at least partially threaded through the middle portion 100 and the extending portion 200.

In an embodiment, the hydraulic oil pipe can be threaded into the bending boom 10 through the side plate bending section 521 on one side, and threaded out through the side plate bending section 521 on the other side. By doing so, the hydraulic oil pipe can be fixed by the bending boom 10, and since the middle portion 100 is always in a relatively fixed state with the hydraulic oil pipe during the unfolding process of the bending boom 10, a problem that the hydraulic oil pipe may be stretched to be broken during the unfolding process of the bending boom 10 can be prevented, in order to protect the hydraulic oil pipe. In addition, the boom device 1 can have a more compact structure, which facilitates the installation and arrangement, the structure is simple, and the use effect is good.

Finally, it should be noted that the above embodiments are only used to describe the technical solutions of the present application rather than to limit the present application. Those skilled in the art should understand that, although the present application has been described in detail with reference to the above embodiments, the technical solutions described in the above embodiments can be modified, or some of the technical features can be equivalently substituted, and those modifications or substitutions cannot make the essence of the corresponding technical solutions deviate from the scope of the technical solutions in the embodiments of the present application.

What is claimed is:

1. A bending boom, comprising:

a middle portion configured to connect an external component; and two extending portions, each of the two extending portions having a first side wall and a second side wall opposite to the first side wall, wherein the first side wall is flush with the middle portion, and the second side wall is at least partially bent from the middle portion towards a direction near the first side wall;

wherein the two extending portions are connected to two opposite ends of the middle portion, the first side walls of the two extending portions are connected to two different side walls of the middle portion, and the second side walls of the two extending portions are connected to two different side walls of the middle portion;

the second side wall comprises a bending section, one end of the bending section is connected to the middle portion, and the bending section is bent from the middle portion towards a direction near the first side wall; and the bending section is arc-shaped, and a curvature in a middle of the bending section is greater than a curvature on two end portions of the bending section.

2. The bending boom according to claim 1, wherein the first side wall and the second side wall of the same extending portion are provided on two opposite sides of the bending boom in a horizontal plane.

3. The bending boom according to claim 2, wherein a longitudinal section area of the extending portion gradually decreases from the middle portion towards a direction away from the middle portion.

4. The bending boom according to claim 1, wherein the second side wall further comprises a connecting section, the connecting section is connected to one end of the bending section away from the middle portion, and the connecting section is parallel to the first side wall.

5. The bending boom according to claim 1, wherein the bending boom further comprises an oil cylinder base, and the oil cylinder base is connected to the middle portion and configured to connect an external oil cylinder.

6. A boom device, comprising:

a front boom;

a rear boom; and the bending boom according to claim 1, wherein the front boom and the rear boom are articulated to two ends of the bending boom.

* * * * *